United States Patent [19]

Bibbee

[11] Patent Number: 4,986,467

[45] Date of Patent: Jan. 22, 1991

[54] MAILBOX DELIVERY SIGNAL APPARATUS

[76] Inventor: E. Bruce Bibbee, 2281 Baird Rd., Fostoria, Ohio 44830

[21] Appl. No.: 446,004

[22] Filed: Dec. 5, 1989

[51] Int. Cl.[5] ..... B65D 91/00

[52] U.S. Cl. ..... 232/34; 232/35

[58] Field of Search ..... 232/34, 35

[56] References Cited

U.S. PATENT DOCUMENTS

| | | | |
|---|---|---|---|
| 842,767 | 1/1907 | Clark . | |
| 1,123,647 | 1/1915 | Ackman | 232/34 |
| 1,334,106 | 3/1920 | Mackey | 232/34 |
| 2,551,915 | 5/1951 | Turner | 232/34 |
| 3,166,241 | 1/1965 | Leutheuser | 232/34 |
| 3,275,228 | 9/1966 | Golla | 232/34 |
| 4,065,050 | 12/1977 | Hunt | 232/34 |
| 4,186,870 | 2/1980 | Walden | 232/35 |
| 4,390,122 | 6/1983 | Savko | 232/35 |
| 4,570,846 | 2/1986 | Morgrey | 232/35 |
| 4,815,656 | 3/1989 | Smith et al. | 232/34 |

*Primary Examiner*—Blair M. Johnson

*Attorney, Agent, or Firm*—Marshall & Melhorn

[57] ABSTRACT

A mailbox delivery signal apparatus includes a signal assembly coupled to a detection assembly. The signal assembly has a signal mast attached at one end to a wheel biased to an upright position by a torsion spring. The wheel is pivotally mounted on a hub attached to a housing attached to an outer surface of a sidewall of the mailbox. The housing includes a stop for engaging the signal mast and preventing further rotation past the upright "mail present" signalling position. The signal mast is maintained in the down "mailbox empty" signalling position by a spring biased pin which engages a detent recess formed in the periphery of the wheel. The detection assembly includes an arm pivotally mounted within the mailbox which arm rotates when an object is placed in the mailbox. The arm is coupled to the pin so that rotation of the arm moves the pin out of engagement with the detent recess in the wheel, permitting the torsion spring to rotate the signal mast to the upright signalling position.

16 Claims, 2 Drawing Sheets

MAILBOX DELIVERY SIGNAL APPARATUS

BACKGROUND OF THE INVENTION

The present invention relates generally to a mailbox signal apparatus and, more particularly, to an apparatus which raises a signal mast to an upright position when an object such as a piece of mail is placed in the mailbox.

The typical curbside mailbox has a manually actuated flag for alerting the mail carrier of outgoing mail to be picked up when in an upright position. The mail carrier lowers the flag to indicate that the service is complete. However, the postal patron has no indication of whether incoming mail has been delivered. It is especially important during inclement weather or when it is physically difficult to make a trip to the mailbox to be provided with an indication that incoming mail is waiting.

Prior art mailbox signal devices have used a number of different methods to activate a signal flag automatically, including raising the flag by a torsion spring released by a spring biased rod. Examples of such designs include U.S. Pat. Nos. 2,551,915; 4,065,050; 4,186,870; and 4,390,122.

However, the signal flags of these devices require either manual actuation of a trigger device or are automatically activated by the opening of the mailbox door. Anyone could actuate these devices without leaving a piece of mail. Therefore, these signal devices are incapable of signalling when a piece of mail is actually in the mailbox. Rather, these devices merely indicate that the mailbox door has been opened.

SUMMARY OF THE INVENTION

In accordance with the present invention, there is provided a mailbox delivery signal apparatus comprising a signal assembly coupled to a detection assembly. The signal assembly includes a signal mast attached at one end to a wheel biased to an upright position by a torsion spring. The wheel is pivotally mounted on an axle attached to a housing, which is adapted to be attached to an outer surface of a sidewall of the mailbox. The housing includes a stop for engaging the signal mast in the upright position and preventing further rotation of the signal mast past the upright "mail present" signalling position. The signal mast is maintained in the down "mailbox empty" signalling position by a pin slidably mounted in the housing which pin is biased by a compression spring to engage a detent recess formed in the periphery of the wheel.

The signal assembly is activated by the detection assembly which includes an arm pivotally mounted within the mailbox which arm rotates when an object is placed in the mailbox. The arm is coupled to the pin so that rotation of the arm moves the pin out of engagement with the detent recess in the wheel, permitting the torsion spring to rotate the signal mast to the upright signalling position.

It is an object of the present invention to provide an improved mailbox delivery signal apparatus.

Another object of the invention is to provide a signal apparatus which is activated by placement of an object within a mailbox.

Still another object of the invention is to provide an apparatus for signalling the delivery of mail which apparatus can be attached to existing mailboxes.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
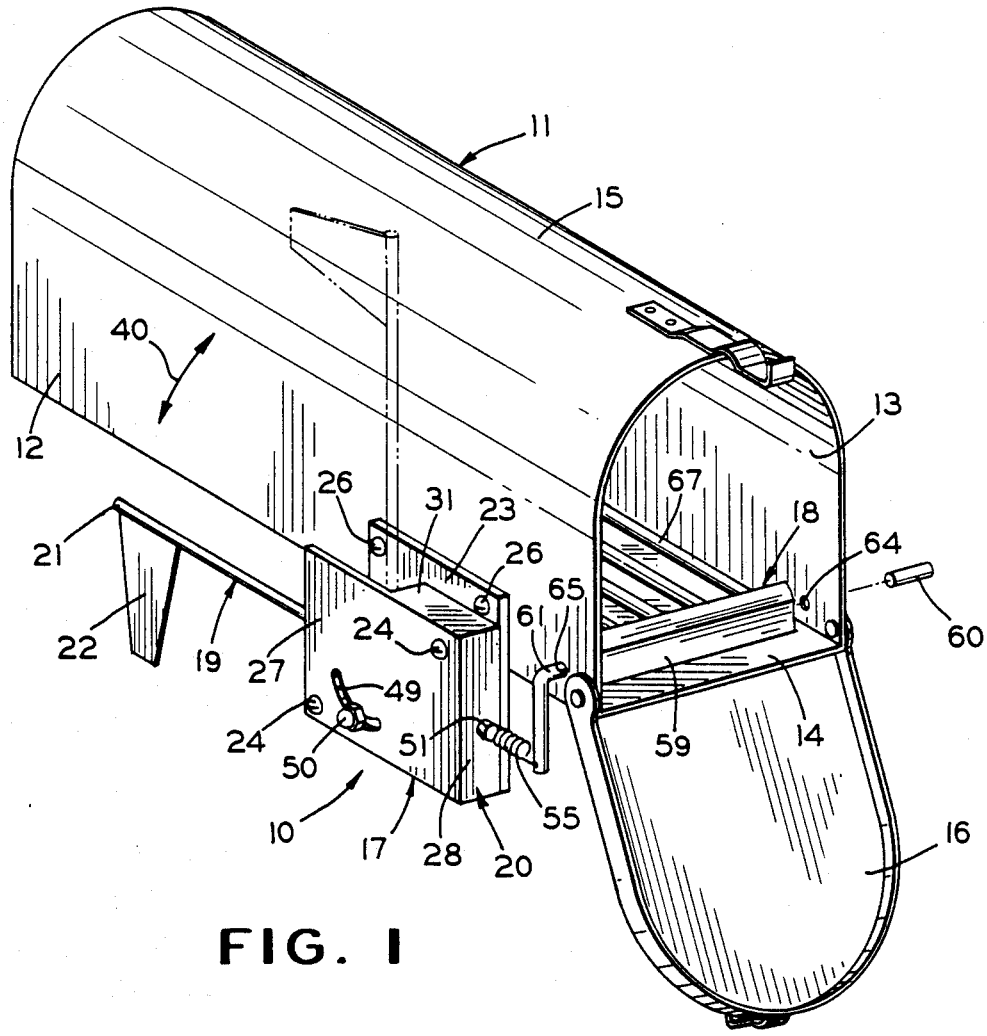
FIG. 1 is a perspective view of a mailbox having a mailbox delivery signal apparatus in accordance with the present invention installed thereon.

Referring now to the drawings, there is illustrated in FIG. 1 a mailbox delivery signal apparatus 10 embodying the present invention mounted to a mailbox 11. The mailbox 11 is formed with a pair of spaced apart sidewalls 12 and 13 connected along lower edges by a bottom wall 14 and along upper edges by a curved top wall 15. A rear end of the mailbox is closed by a rear wall (not shown) and a front end is selectively closed by a pivotally mounted door 16. Thus, the mailbox 11 is conventional in construction and can be formed of any suitable material.

Figure 2:
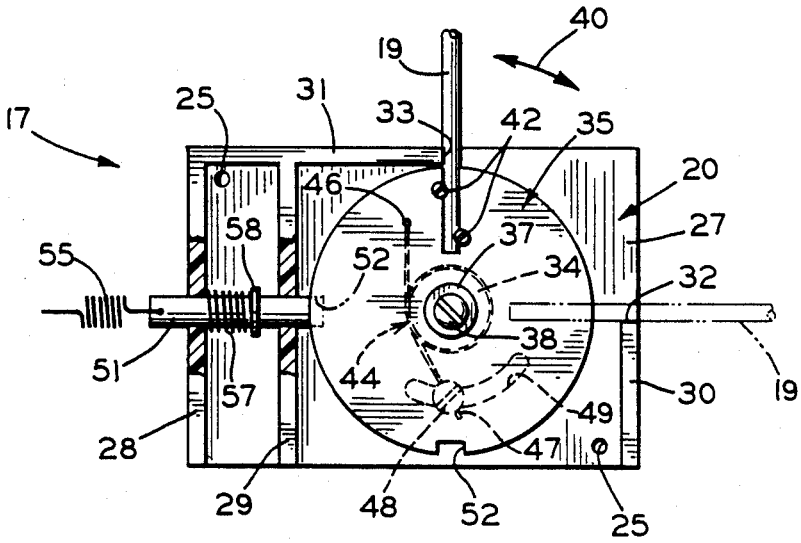
FIG. 2 is an enlarged, fragmentary side elevational view of the signal assembly of the signal apparatus shown in FIG. 1.
Figure 3:
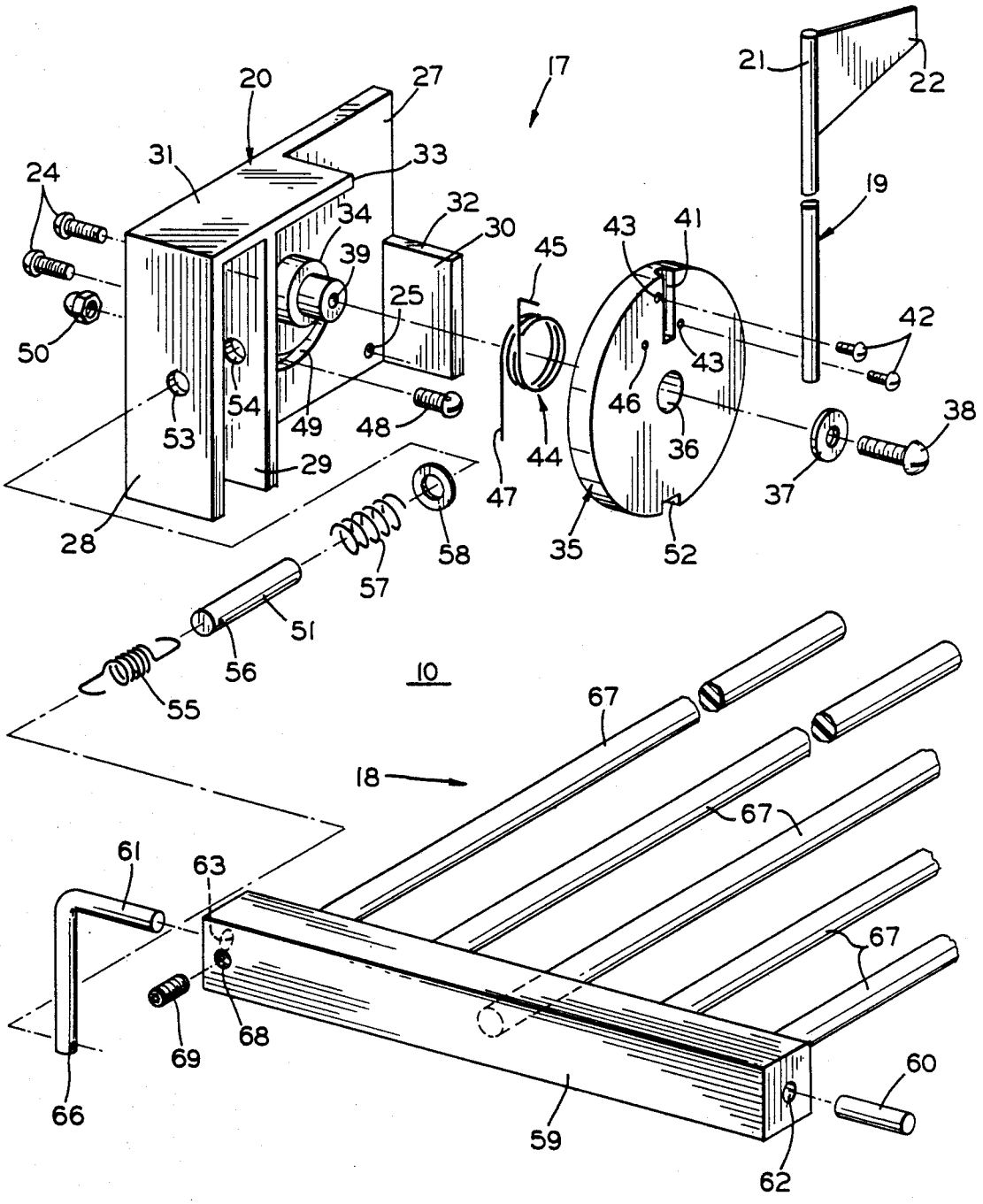
FIG. 3 is an exploded perspective view of the signal apparatus shown in FIG. 1.

As shown in FIGS. 1 through 3, the mailbox delivery signal apparatus 10 includes a signal assembly 17 coupled to a detection assembly 18. The signal assembly 17 has a signal mast 19 pivotally mounted at one end within a housing 20. The opposite distal or signal end 21 of the signal mast 18 includes a flag 22. The housing 20 is adapted to be attached to an outer surface of the sidewall 12 of the mailbox 11. The housing 20 is affixed to a plate 23 in a conventional manner by, for example, threaded fasteners 24 extending through apertures 25 (only one is shown) formed in the housing. The plate 23 is similarly first affixed to the sidewall 12 by threaded fasteners 26.

The housing 20 is formed with a planar sidewall 27 extending generally parallel to the plane of the plate 23. Extending at right angles to the sidewall 27 are three generally vertical walls, a front end wall 28, an intermediate wall 29 and a rear end wall 30. The walls 28 and 29 extend the entire height of the sidewall 27 and are joined along top edges thereof by a generally horizontally extending top wall 31. The widths or depths of the walls 28 through 31 are approximately equal such that the sidewall is maintained spaced from and parallel to the plate 23 and the sidewall 12 of the mailbox 11. The height of the rear end wall 30 is selected such that an upper edge 32 of the wall functions as a stop for the signal mast 19 in the down position as shown in phantom line in FIG. 2. The length of the top wall 31 is selected such that a rear edge 33 of the wall functions as a stop for the signal mast 19 in the upright position as shown in FIG. 2.

As shown in FIGS. 2 and 3, a stepped hub or axle 34 of generally cylindrical cross section extends from an inner surface of the sidewall 27. The proximal end of the signal mast 19 extends into the housing 24 through a gap between the edges 32 and 33 of the walls 30 and 31 respectively and is affixed to a wheel 35 rotatably mounted on the hub 34. The wheel 35 has a central aperture 36 formed therein for accepting a smaller diameter portion of the hub 34. The wheel 35 is retained on the hub 34 by any suitable means such as a washer 37 and a threaded fastener 38 threadably engaging a central aperture 39 formed in the hub 34. The wheel 35 is rotatable on the hub 34 for rotation in either direction as indicated by an arrow 40.

On the surface facing the plate 33, the wheel 35 is provided with a radially extending slot 41 having a generally semi-circular cross section as shown in FIG. 3. The slot 41 extends from a periphery of the wheel 35 toward the central aperture 36 and the proximal end of the signal mast 19 is retained in the slot 41, in any conventional manner, such as by the heads of a pair of threaded fasteners 42 threadably engaging apertures 43 on opposite sides of the slot 41.

A torsion spring 44 extends around a larger diameter portion of the hub 34 trapped between the sidewall 27 and the wheel 35. One end 45 of the torsion spring 44 extends parallel to the coil axis and engages an aperture 46 formed in the wheel 35 between the periphery of the wheel and the central aperture 36 An opposite end 47 of the spring 44 is attached to the housing 24 by an adjustment bolt 48. The adjustment bolt 48 extends through and is slidable in an arcuate slot 49 formed in the sidewall 27. A head end of the adjustment bolt 48 traps the spring end 47 against the inner surface of the sidewall 27 and a threaded end of the adjustment bolt 48 threadably engages an adjustment nut such as an acorn nut 50. By loosening the adjustment nut 50, a user can move the adjustment bolt 48 along the slot 49, thereby either increasing or decreasing the amount of tension generated by the torsion spring 44. This allows the user to adjust the amount of rotational force applied to the signal mast 19 by the torsion spring 44.

Prior to actuation of the signal assembly 17, the signal mast 19 is held in the down position by a pin 51 one end of which engages a detent recess 52 formed in the periphery of the wheel 35 thereby preventing rotation of the wheel 35 by torsion spring 44. The pin 51 is slidably mounted in a pair of apertures 53 and 54 formed in the walls 28 and 29 respectively for movement parallel to the longitudinal axis of the pin 51. An opposite end of the pin 51 is connected to one end of a tension spring 55. An aperture 56 is formed in the pin 51 extending transverse to the longitudinal axis of the pin for retaining a generally C-shaped end of the spring 55.

A central portion of the pin 51 extends through the coils of a compression spring 57. One end of the spring 57 abuts an inner surface of the end wall 28 and an opposite end abuts a washer 58 affixed to the pin 51 by any suitable means such as gluing. The compression spring 62 thereby biases the one end of the pin 51 into engagement with the detent recess 52.

The detection assembly 18, as shown in FIG. 4, includes an object detecting arm pivotally mounted at one end within the mailbox 11 and coupled to the signal assembly 17. The arm includes a transverse bar 59 which extends across the open end of the mailbox 11. The bar 59 is rotatably mounted to the opposing sidewalls 12 and 13 on a pair of axle shafts 60 and 61. The axle shaft 60 is generally straight and one end is retained in an aperture 62 formed in an end of the bar 59 and extending along a longitudinal axis of the bar. Similarly, one end of the axle shaft 61 is retained in an aperture 63 formed in an opposite end of the bar 59 and extending along the longitudinal axis of the bar. The axle shaft 60 extends through an aperture 64 formed in the sidewall 13 and the axle shaft 61 extends through an aperture 65 formed in the sidewall 12. The axle 61 is generally L-shaped with an opposite end functioning as a release lever having a transverse aperture 66 formed therein for retaining the other C-shaped end of the spring 55.

Attached to the bar 59 and extending transverse to its longitudinal axis are a plurality of rods 67. One end of each of the rods 67 is retained in a corresponding aperture formed in the bar 59 as shown in FIG. 3. Typically, the bar 59 and the rods 67 are formed of a strong, yet relatively light material, such as an acrylic plastic. Although the bar is shown as having a generally square cross section and the rods are shown as being circular in cross section, any suitable shape can be utilized.

The signal apparatus 10 can be installed when the mailbox 11 is manufactured or added later. The signal assembly 17 is preassembled with the exception that the housing 20 is not yet attached to the plate 23. In the detection assembly 18, only the rods 67 are assembled to the bar 59. The plate 23 is attached to the sidewall 12 with the fasteners 26 and the housing 20 is attached to the plate 23 with the fasteners 24. The apertures 64 and 65 are formed in the sidewalls 13 and 12 respectively. The bar 59 with the rods 67 form the arm which is positioned inside the mailbox 11 and the axle 60 is inserted through the aperture 64 into the aperture 62 in the adjacent end of the rod 59. The axle 61 is inserted through the aperture 65 into the aperture 63 in the adjacent end of the rod 59.

The force applied to the end of the release lever end of the axle 61 by the tension spring 55 must be such to balance the corresponding rotational force exerted on the bar 59 by the weight of the elongate rods 67. This balance is attained by adjusting the relative rotational position of the release lever end of the axle 61 relative to a generally horizontal plane in which the rods 67 must lie. A threaded aperture 68 is formed in the bar 59 perpendicular to the axis of the bar and intersecting the aperture 63. A set screw 69 is threadably engaged in the aperture 68. When the axle 61 has been rotated to the desired position, the set screw 86 is threaded into engagement with the axle 61 to prevent further relative movement between the bar 59 and the axle 61 such that the arm defined by the bar 59 and the rods 67 extends generally parallel to the bottom wall 14 of the mailbox 11.

Once adjusted, placement of an object, even a relatively light object, in the mailbox 11 on the elongate rods 67 will upset the balance activating the signal. The weight of the object forces the distal ends of the elongate rods 67 downwardly toward the bottom wall 14. The downward movement of the rods 67 rotates the bar 59 about its longitudinal axis on the axles 60 and 61. The release lever end of the axle 61 is rotated in a counterclockwise direction in an arcuate path away from the signal assembly 17. This in turn extends the spring 55 pulling the pin 51 away from the periphery of the wheel 35 and out of engagement with the detent recess 52.

With the pin 51 no longer in engagement with the detent recess 52 of the wheel 35, the torsion spring 44 will rotate the wheel 35 and signal mast 19 from the down position to the upright position against the rear edge stop 33. Thus, the opening of the door 16 does not actuate the present invention nor is the mail carrier required to actuate the present invention.

To reset the signal apparatus 10, all objects must be removed from the mailbox 11 The signal mast 19 is forced downwardly against the upper edge stop 32 by the user. The wheel 35 will be rotated until the detent recess 52 is once again aligned with the pin 51. The compression spring 57 forces the pin 51 into engagement with the detent recess 52 preventing rotation of the wheel 35 and signal mast 19 from the down position. The movement of the pin 51 into engagement with detent recess 52 rotates the axle 61, by means of the tension spring 55, in a clockwise direction. This causes the rotation of the bar 59 until the elongate rods 67 are again balanced in the horizontal position.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A signal apparatus for use with a mailbox having a side wall comprising:

a signal assembly adapted to be attached to an outer surface of a sidewall of a mailbox and movable between a down position and an upright position including a housing adapted to be attached to the outer surface of the sidewall and a signal mast having one end rotatably mounted in said housing; and a detection assembly adapted to be pivotally mounted in the mailbox for rotation when an object is placed on said detection assembly, said detection assembly being coupled to said signal assembly whereby said rotation of said detection assembly moves said signal assembly from the down position, wherein said housing includes a hub and a wheel rotatably mounted on said hub, said one end of said signal mast being attached to said wheel to the upright position.

2. The apparatus according to claim 1 wherein said signal mast has a signal end with a flag rotatable between the down position and the upright position.

3. The apparatus according to claim 1 wherein said signal assembly includes a torsion spring extending around said hub and having one end attached to said wheel and an opposite end attached to said housing for rotating said wheel and said signal mast from the down position to the upright position.

4. The apparatus according to claim 3 wherein said housing includes a stop for preventing rotation of said signal mast beyond the down position.

5. The apparatus according to claim 3 wherein said housing includes a stop for preventing rotation of said signal mast beyond the upright position.

6. The apparatus according to claim 3 wherein said signal assembly includes a spring biased pin slidably mounted in said housing for movement of one end of said pin against a periphery of said wheel to engage a detent recess formed in said wheel and maintain said signal mast in the down position.

7. The apparatus according to claim 6 wherein said detection assembly includes an arm coupled to said pin for rotation when an object is placed on said arm whereby said rotation of said arm moves said pin out of engagement with said detent recess permitting said torsion spring to rotate said signal mast to the upright position against said stop.

8. The apparatus according to claim 7 wherein said arm includes a block rotatably mounted between sidewalls of the mailbox and a plurality of rods attached to said block.

9. The apparatus according to claim 8 wherein said block and said rods are formed of a plastic material.

10. A signal apparatus for use with a mailbox having a sidewall comprising:

a housing adapted to be attached to an outer surface of a sidewall of a mailbox;

a signal mast having one end rotatably mounted in said housing and a signal end spaced from said one end for rotation between a down position and an upright position of the signal end of said signal mast;

a torsion spring having one end connected to said signal mast and an opposite end attached to said housing for rotating said signal mast from the down position to the upright position;

a stop on said housing for engaging said signal mast in the upright position and preventing further rotation by said torsion spring past the upright position;

a spring biased pin slidably mounted in said housing to a first position for maintaining said signal mast in the down position; and a detection assembly pivotally mounted in the mailbox for rotation when an object is placed on said detection assembly, said detection assembly being coupled to said pin whereby said rotation of said detection assembly moves said pin to a second position permitting said torsion spring to rotate said signal mast to the upright position against said stop.

11. The apparatus according to claim 10 wherein said housing includes a hub and a wheel rotatably mounted on said hub and said torsion spring is mounted on said hub and trapped between said wheel and a sidewall of said housing.

12. The apparatus according to claim 11 including means for adjusting the rotational force applied by said torsion spring to rotate said wheel.

13. The apparatus according to claim 12 wherein said means for adjusting the rotational force applied by said torsion spring includes an arcuate slot formed in a sidewall of said housing and a fastener slidably movable in said slot, a head of said fastener trapping one end of said torsion spring against said sidewall.

14. A signal apparatus for use with a mailbox having a sidewall comprising:

a housing adapted to be attached to an outer surface of a sidewall of a mailbox;

a signal mast having one end attached to a wheel and a signal end spaced from said one end;

a hub attached to said housing and pivotally mounting said wheel for rotation between a down position and an upright position of the signal end of said signal mast;

a torsion spring extending around said hub and having one end attached to said wheel and an opposite end attached to said housing for rotating said wheel and said signal mast from the down position to the upright position;

a stop on said housing for engaging said signal mast in the upright position and preventing further rotation by said torsion spring past the upright position;

a pin slidably mounted in said housing for movement parallel to a longitudinal axis of said pin;

a compression spring mounted on said housing and coupled to said pin for forcing one end of said pin against a periphery of said wheel to engage a detent recess formed in said wheel and maintain said signal mast in the down position; and a detection assembly including an arm pivotally mounted in the mailbox for rotation when an object is placed on said detection assembly, said detection assembly being coupled to said pin whereby said rotation of said detection assembly moves said pin out of engagement with said detent recess permitting said torsion spring to rotate said signal mast to the upright position against said stop.

15. The apparatus according to claim 14 including means for adjusting the rotational force applied by said torsion spring to rotate said wheel.

16. The apparatus according to claim 14 including a mailbox having a pair of spaced apart sidewalls connected along lower edges thereof to a bottom wall, said arm being pivotally mounted at one end on said sidewalls and extending generally parallel to said bottom wall when said signal mast is in the down position.

* * * * *